United States Patent [19]

Candor

[11] 3,949,987

[45] Apr. 13, 1976

[54] GOLFER'S AID

[76] Inventor: James T. Candor, 5440 Cynthia Lane, Dayton, Ohio 45429

[22] Filed: Apr. 25, 1974

[21] Appl. No.: 464,102

Related U.S. Application Data

[60] Division of Ser. No. 307,977, Nov. 20, 1972, Pat. No. 3,820,786, which is a continuation-in-part of Ser. No. 220,045, Jan. 24, 1972, abandoned.

[52] U.S. Cl. ..... 273/176 L; 35/29 A

[51] Int. Cl.[2] ..... A63B 57/00; A63B 69/36

[58] Field of Search ..... 273/134 CG, 176 L, 32; 283/1 A; 35/62, 7 R, 7 A

[56] References Cited

UNITED STATES PATENTS

| | | | |
|---|---|---|---|
| 1,034.943 | 8/1912 | Wohlauer | 283/1 A |
| 1,470,117 | 10/1923 | MacRae | 273/176 L |
| 1,520,081 | 12/1924 | Purnell | 273/134 CG |
| 2,791,040 | 5/1957 | Santorelli | 35/62 |
| 3,260,526 | 7/1966 | Seitz | 273/134 CG |
| 3,552,290 | 1/1971 | Brechtel | 273/176 L |

*Primary Examiner*—George J. Marlo
*Attorney, Agent, or Firm*—Candor, Candor & Tassone

[57] ABSTRACT

A golfer's aid for laying out in simulation form one or more holes of golf for the purpose of studying and then subsequently playing each such hole for the minimum score for the golfer's ability wherein each simulated hole is provided by a first sheet having concentric arcs thereon to designate increments of distance from a golf green disposed at the center of the arcs. A golf tee area is disposed on the first sheet at a preselected distance from the green and hazards and landmarks are also disposed on the first sheet between the tee area and the golf green to simulate the hazards and landmarks the golfer might encounter when playing that particular hole of golf. A smaller, transparent sheet having concentric arcs thereon designating increments of distance from a point on the smaller sheet is disposed on the first sheet with the point of the smaller sheet at the golf tee area and with its incremental markings being directed in a desired direction toward the golf green. The two sheets can be contained in a transparent envelope-like member for protection purposes and to facilitate marking strategy plans in overlay on the golfer hole.

3 Claims, 10 Drawing Figures

GOLFER'S AID

This application is a division of application Ser. No. 307,977, filed Nov. 20, 1972,now U.S. Pat. No. 3,820,786, which is a continuation-in-part application of application Ser. No. 220,045, filed Jan. 24, 1972, now abandoned.

This invention relates to a book means or kit for laying out one or more holes of a golf course in a simulating manner so that the golfer can not only plan in advance the playing of that particular golf course with a stroke and club plan commensurate with the golfer's ability but also to provide means for that golfer to record his round of golf for a more accurate later study thereof to enhance self improvement in the playing of golf.

It is well known that one of the greatest professional golfers of all time, Jack Nicklaus, makes notes about a golf course he is practicing on for a subsequent tournament so that he will accurately know the distances from various landmarks to the greens and thus can choose the proper clubs for second and third shot situations, a practice that obviously has paid off Mr. Nicklaus.

It is also well known from the book, *Situation Golf*, by Arnold Palmer and published by McCall Publishing Company of New York in 1970, that the author stresses the fact that before the golfer actually tees off on a particular hole of golf, he should have a full battle plan for the hole worked out in his mind in order to best score in a manner that takes in the ability of the golfer. In fact, such book sets forth nine holes of simulated golf play and how each hole should be played by a golfer with a low handicap, a medium handicap and a high handicap.

Golf Magazine's book, *Handbook of Golf Strategy*, states that at some time, a golfer who regularly plays a certain golf course should make a sketch of each hole and indicate thereon where to play positions, such book thereafter devoting part of a chapter to explain how to chart a golf course.

Therefore, it is a feature of this invention to provide means wherein a golfer can utilize the strategy conveyed in such books to lay out a round of golf that that player normally plays in a simulated manner and with which that player can thereafter make adjustments in his game to fit his battle plan for that particular golf course so as to practice the teachings set forth in the aforementioned books, *Situation Golf* and *Handbook of Golf Strategy*.

In particular, one embodiment of this invention provides a book means or kit wherein each golf hole is provided by a standardized first sheet having concentric arcs disposed thereon and respectively being described from a point on the sheet to designate increments of distance from that point. The golfer can place a simulated golf green at that point to represent the golf green for a particular hole of golf that he desires to play. The golfer also disposes a golf tee area on the sheet at a preselected distance from the point thereon as well as disposes pieces representing natural hazards and/or landmarks on the sheet between the tee area and the golf green so as to simulate that particular hole of golf. A smaller, transparent sheet having concentric arcs described from a point on the smaller sheet to designate increments of distance from that point is placed on the first sheet with the point of the smaller sheet on the golf tee area and with its incremental means directed in a desired "drive" or first shot direction toward the golf green. Such smaller sheet is then marked on by the golfer to designate a desired first shot area from the tee area where the golfer should place his first shot in order that succeeding shots, also laid out on the assembled sheets, will conform to the ability of that golfer in playing that particular hole to the best of his natural ability and with a little shot trouble as possible.

Each pair of such completed and assembled sheets can then be disposed as a unit into a transparent envelope or pocket means so that the simulated hole of golf can be readily viewed therethrough. Such covered sheets can then be detachably secured in a notebook-like cover and be utilized during the actual playing of the round of golf for reference purposes and/or for record keeping purposes so that when that particular hole is actually played, the golfer can mark on the outer covering sheet the various shots, all positions and clubs utilized in playing that particular hole of golf so that the same can be later studied at his leisure for beter perfecting his golf game and perhaps for changing his battle plane for that particular hole of golf. Alternately, each of such covered and assembled sheets can be utilized in a duplicating machine to provide a copied sheet therefrom and which can also be marked upon when that golfer plays that particular hole to record the various shots taken, etc. for later study and later permanent record-keeping purposes. For example, by keeping such a permanent record of each round of golf played for a year will indicate the best possible battle plan of that golfer for the following year, etc.

Therefore, it is an object of this invention to provide a book means or kit having at least one page means for simulating a hole of golf that a golfer will actually play in a manner that the golfer can pre-plan his strategy for playing such hole of golf.

Other objects, uses and advantages of this invention are apparent from a reading of this description which proceeds with reference to the accompanying drawings forming a part thereof and wherein:

FIG. 9 is a reduced perspective view of a plurality of book means of FIG. 1 stored on a shelf or the like.

While this invention is particularly adapted for laying out one or more actual holes of golf that a golfer is to play, it is to be understood that the various features of this invention can be utilized singly or in any combination thereof to lay out holes of golf that are yet to be in existence for practicing battle plan techniques or for other purposes as desired.

Figure 1:
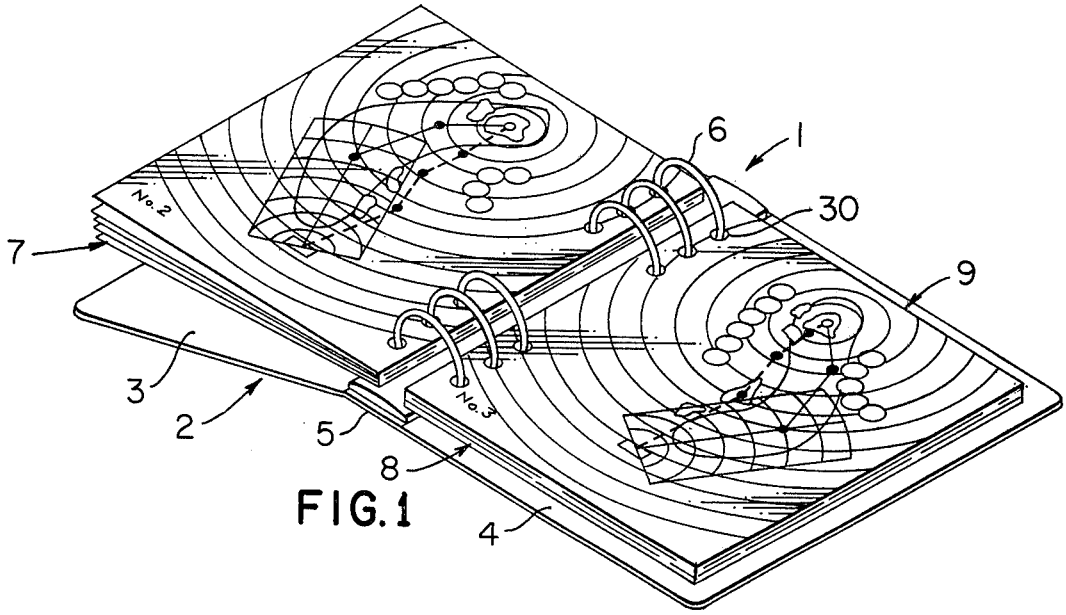
FIG. 1 is a perspective view of the golf course study book means or kit of this invention opened to a particular page means thereof after the page means has been utilized to simulate a particular golf hole.

Referring now to FIG. 1, the golf course study book means or kit of this invention is generally indicated by the reference numeral 1 and comprises a notebook-like cover 2 having a front part 3, a back part 4 and a spine part 5 hinged to said front and back parts 3 and 4 and being provided with a plurality of operable rings 6 that detachably hinge and secure a plurality of page means 7 and 8 inside the book means 1. The page means 7 can comprise instructions and material for assisting in the laying out of a complete eighteen hole golf course hole-by hole as will be apparent hereinafter on the page means 8 whereby each page means 8 can comprise two holes of the golf course to be studied an played respectively on opposite sides thereof. Thus, only nine page means 8 need be provided for each book means 1 and the same can be utilized to lay out a complete golf course for the reasons previously set forth as well as for the reasons hereinafter set forth and illustrated, such page means 8 being protected by the notebook cover means 2 during the use of the kit 1 for its intended purpose.

Figure 1A:
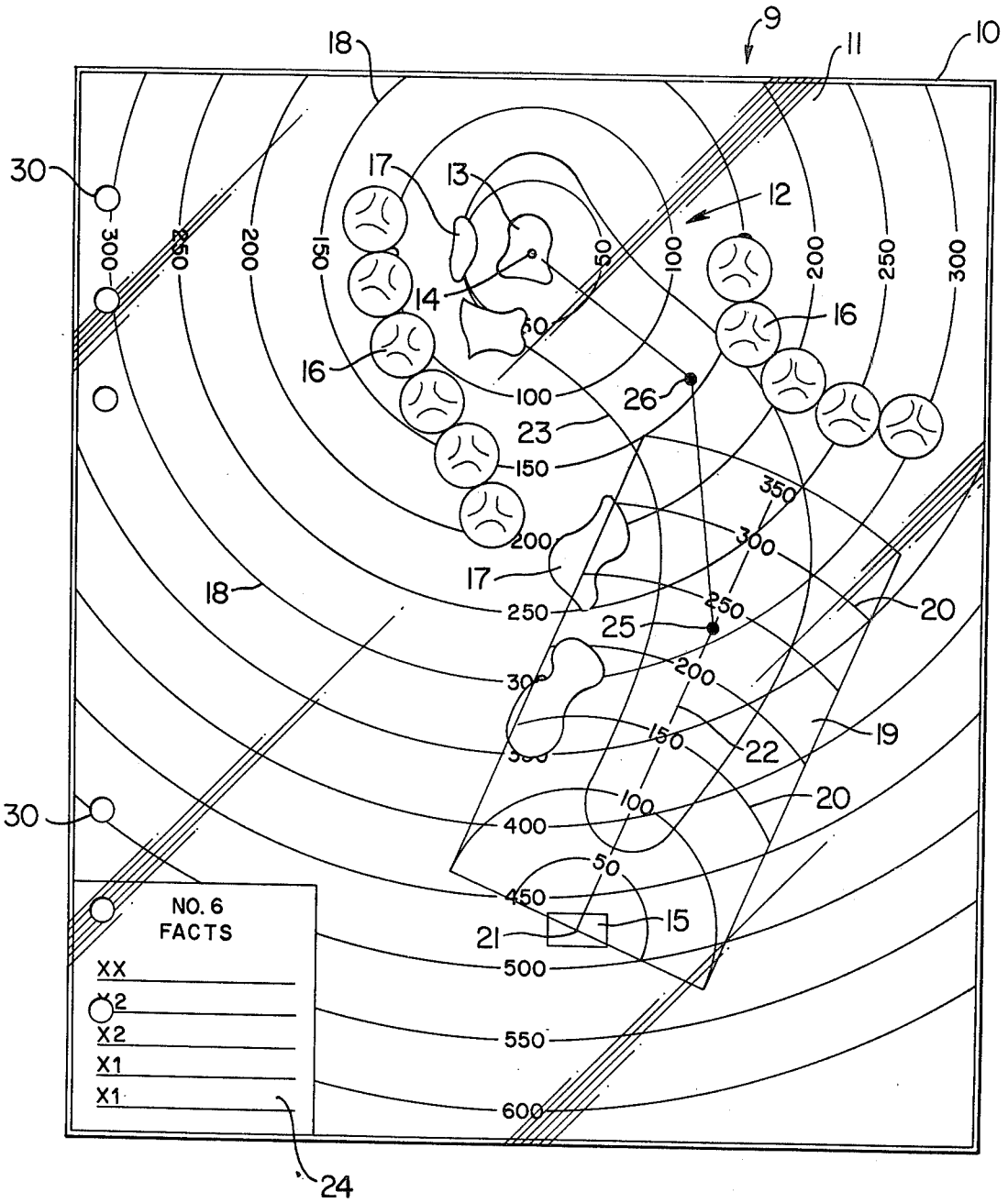
FIG. 1A is a plan view of one pair of assembled sheets of this invention disposed in a transparent pocket means to form one page means for the book means of FIG. 1 and representing a particular hole of golf that a golfer will subsequently play.

Referring now to FIG. 1A, one page means 8 of the book means 1 is illustrated after the same has been utilized to produce a unit 9 that is a completed simulation of a particular hole of golf and comprises an outer transparent covering envelope or pocket member 10 having disposed therein a first sheet means 11 on which the simulated hole of golf is provided and is generally indicated by the reference numeral 12. The hole of golf 12 comprises a simulated golf green 13 disposed on the sheet 11 and having as its center a point 14 provided on the sheet 11. A golf tee off area 15 is disposed on the sheet 11 in a preselected position from the point 14 of the sheet 11 for representing the golf tee area of the golf hole 12. A plurality of members simulating natural hzards and landmarks, such as trees 16 and traps 17, are disposed on the sheet 11 in positions that most represent the actual hazards of the hole being depicted or simulated by the golf hole 12 of FIG. 1. Such items 16 and 17 can be supplied from the page means 7 of the book means 1.

The sheet 11 has a plurality of preformed arcs 18 provided thereon in concentric manner and each being described from the point 14 on the sheet 11 to designate incremental distances from the point 14 and being of a number that would cover the distances for better than 90% of the holes of golf in actual existence.

A second sheet 19 of transparent material has a plurality of arcs 20 formed thereon in a concentric manner and each being described from a point 21 formed on the sheet 19 so as to represent incremental distance from the point 21.

As illustrated in FIG. 1A, the sheet 19 is laid on the sheet 11 in such a manner that the point 21 of the smaller sheet 19 is disposed in a desired location on the tee area 15 and with the incremental distances 20 thereon being disposed outwardly from the tee area 15 in a desired first shot direction for that particular golfer. If desired, the sheet 19 can actually have a straight line means 22 formed thereon for representing the path of a "drive" or first shot from the tee off area 15 as illustrated.

If desired, the sheet 11 can have a free hand marking or cut-out means disposed thereon to designate an outline 23 of the fairway that is provided by the hole of golf 12 as illustrated.

In addition, a fact sheet 24 can also be disposed on the sheet 11 in an out-of-the-way manner from the hole of golf 12 and on which can be recorded pertinent facts that the golfer should review before actually playing the hole of golf so as to minimize trouble that the golfer might encounter. For example, such fact sheet could remind the golfer that because the fairway is slightly rising from tee area to green he should use a lower number club than that which he would normally be expected to be utilizing for a particular shot. Also, such fact sheet could contain the same type of information that the book, *Situation Golf*, provides for the simulated holes therein and considered as "Pertinent Facts" therein.

After the sheets 11 and 19 have been assembled together in the manner illustrated in FIG. 1A, the golfer can then mark thereon in any appropriate manner the shot path that that particular golfer should follow to use his ability in trying to par or score his best for such hole. Such battle plan can be provided on its assembled sheets by various marking pencils, etc.

For example, the hole 12 illustrated in FIG. 1A is a par 5 hole and the golfer is of average ability so that a first marking 25 is provided for his desired drive of slightly more than 225 yards straight down the fairway. The golfer then locates a marking 26 where it would be most strategic for his second shot to be played in order to avoid what hazards he might encounter while still giving the golfer the best possible approach shot for his ability so as to reach the green 13 on this third shot.

Figure 2:
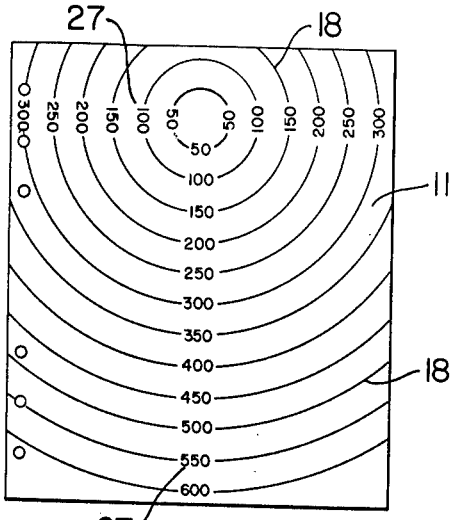
FIG. 2 is a reduced plan view of one of the sheets for forming the combination illustrated in FIG. 1A.
Figure 3:
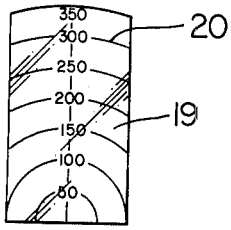
FIG. 3 is a smaller view of another sheet utilized in forming the combination of FIG. 1A.

Such previously described unit 9 for simulating the hole of golf 12, or any other hole of golf can easily be formed by the golfer using the standard sheet 11 of FIG. 2 which has the incremental arcs 18 formed thereon and being appropriately labeled by incremental numbers 27 in any appropriate manner.

Figure 4:
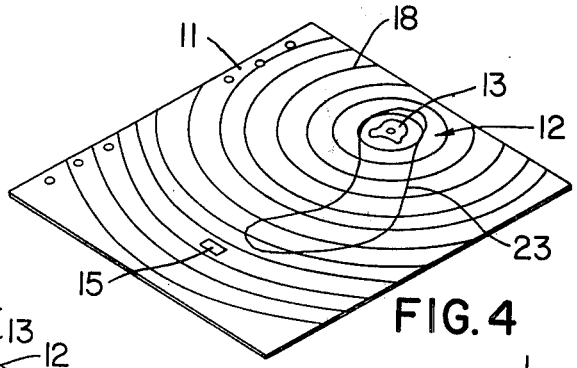
FIG. 4 is a perspective view of the sheet of FIG. 2 having a golf green and a golf tee are disposed thereon as well as an outline of the fairway of the hole of golf that is to be depicted or simulated thereon.

As illustrated in FIG. 4, such sheet 11 has the golf green 13, tee area 15 and fairway designation 23 disposed thereon in initially laying out the golf hole 12.

Figure 5:
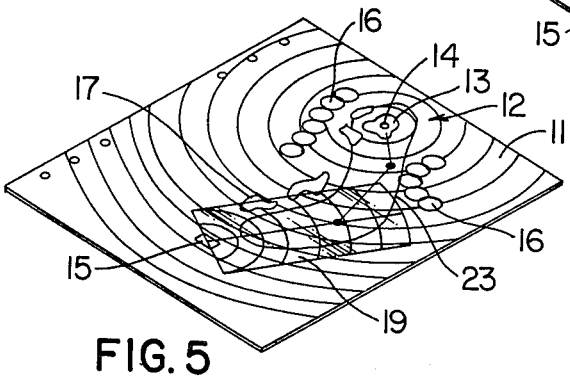
FIG. 5 is a view similar to FIG. 4 and illustrates the second sheet of FIG. 3, as well as means representing natural hazards for the particular hole of golf, being disposed on the sheet of FIG. 4. In addition, the planned shots for the hole of golf are laid out on the assembled sheets in FIG. 5.

Thereafter, the golfer places the golf hazards 16 and 17 and second sheet 19 on the first sheet 11 of FIG. 4 in the manner illustrated in FIG. 5. The battle plan of the best way to play that hole of golf is then marked thereon in the manner previously described.

Figure 6:
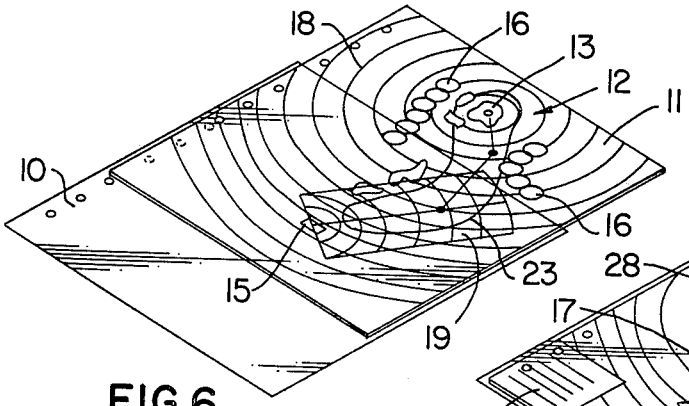
FIG. 6 is a view similar to FIG. 5 and illustrates the assembled sheets of FIG. 5 being inserted in a transparent covering member.
Figure 7:
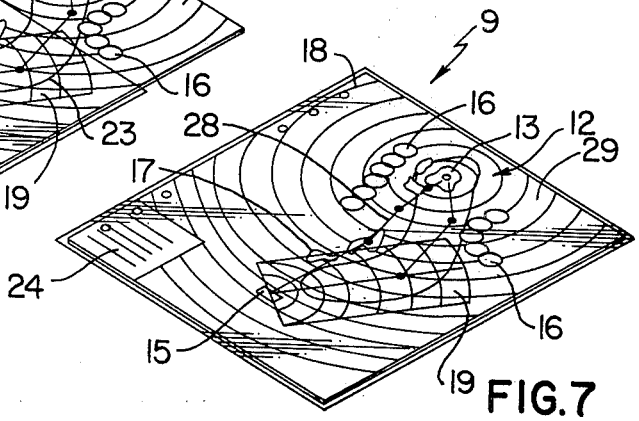
FIG. 7 is a view similar to FIG. 6 and illustrates the assembled sheets fully received within the pocket member and with the pocket member having markings disposed thereon representing an actual playing of the hole of golf simulated by the sheets.

Thereafter, the assembled sheets of FIG. 5 that depict the desired hole of golf are slipped into a transparent envelope or covering pocket member 10 as illustrated in FIG. 6 along with the fact sheet 24 to form the completed unit 9 illustrated in FIGS. 1A and 7.

However, in FIG. 7 the unit 9 is actually used by itself when playing the hole of golf depicted thereon so that the golfer has marked the particular ball's course and strokes by suitable markings 28 on the outer surface 29 of the covering 10 in the manner illustrated in FIG. 7 for later study or recording purposes.

For example, the outer covering 10 can be formed of transparent material that is readily marked by a certain type of marking member, such as a felt pen or the like, and which can be easily cleaned off for later reuse thereof.

Alternately, the user may take the unit 9 of FIG. 1A as a "master" and through the use of Xerox machine or the like form a plurality of copy sheets therefrom for permanent marking thereon as the particular hole of golf is played so that throughout a particular year the golfer can see what improvement he has made throughout the year in scoring on a particular hole and also whether he is playing the hole in the manner that he best believes that he should be attacking such hole.

While only one hole of golf has been previously described as being formed from the book means or kit 1 of this invention, it is to be understood that a person would be provided in kit form or book form a plurality of sheets 11, a plurality of sheets 19, a plurality of sheets having the hazards 16 and 17, as well as other hazards, in predetermined cut out form or for the user's desired cut out configurations, and sheets for the golf greens 13 and tee areas 15 so that the same can either be cut from such sheets or punched therefrom and be disposed on the sheets 11 in a desired manner to prooduce 18 holes of simulated golf holes or more as desired. Of course, such kit would include eighteen pocket members or just nine pocket members so that two holes could be utilized at each pocket member 10 in a back-to-back relation.

The sheets 11 could be formed with a green background and the various hazards, golf greens and tee areas could be formed with other distinct colorings either natural or in a manner to quickly call to the golfer's attention that a certain area is really to be avoided as the same has been constantly his downfall, etc. Also, such members that are to be subsequently disposed on the sheets 11 could be secured thereon in a permanent manner or in a readily removable manner so as to be rearrangeable, if desired.

After the desired number of units 9 have been assembled for a round of golf, the units 1 are reinserted into the notebook cover 2 to be held by the rings 6 that are opened, received through appropriate openings 30 in the pocket member 10 and sheets 11 and then closed in the manner illustrated in FIG. 1 so that the book means 1 can be actually utilized during the playing of a round of golf depicted by the "holes" of golf of the hinged units 9 by having the golfer mark his shots, ball paths, putts and scores thereon for later study and record keeping purposes, if desired.

Of course, instead of marking such information directly on the cover members or pocket members 10, sheets of tracing paper or other material could be inserted in the notebook 1 between each pair of units 9 to be marked on in the above manner for such purposes and therefore the cover members 10 need not require cleaning off of the markings thereon when another round of golf is played.

Figure 8:
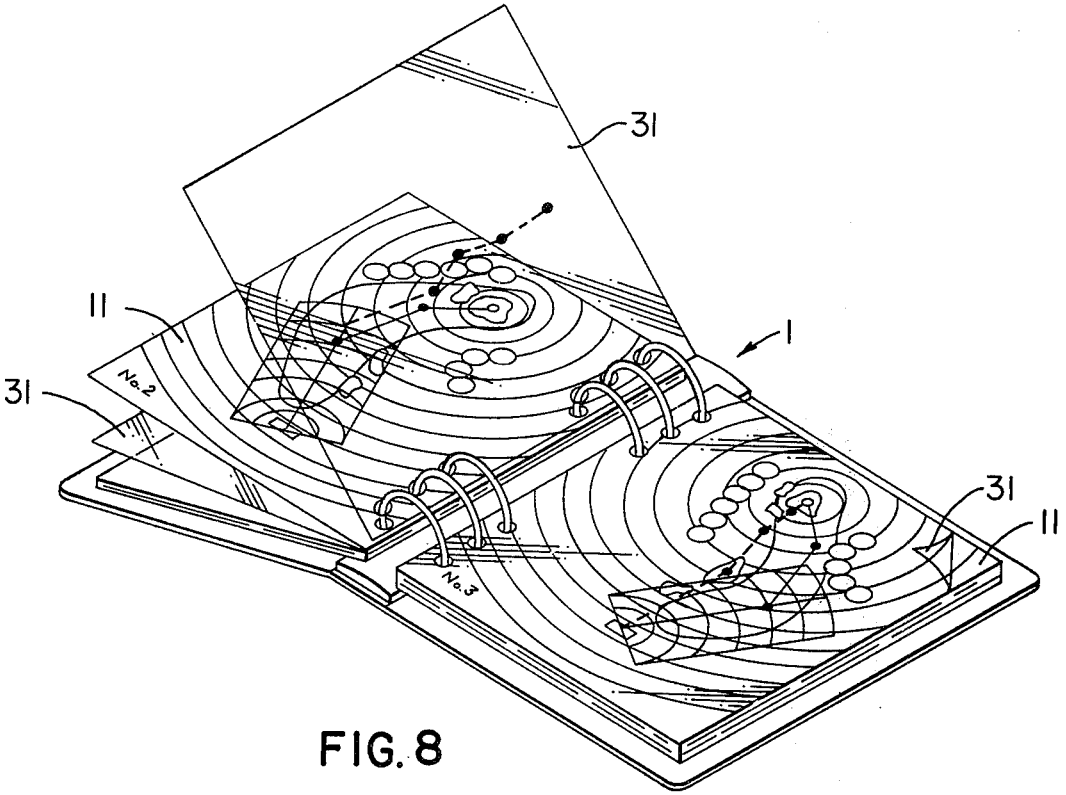
FIG. 8 is a view similar to FIG. 1 and illustrates another embodiment of the golf course study book means or kit of this invention.

If fact, the pocket members 10 could be eliminated in the manner illustrated in FIG. 8 where cover sheets 31 are provided for each side of a completed sheet 11 for the marking thereon in the above manner, the sheets 31 being replaceable sheets or readily eraseable sheets as desired.

Thus, it can be seen that this invention provides means wherein a golfer can lay out one or more golf holes that he normally encounters and from which he can plan his attack of the hole or holes in a manner to best suit his ability and from such information actually keeps records of his golf rounds for any desired purpose.

Also, such golf hole units 9 of this invention can be utilized to record more than one players actual playing of the golf hole for later discussion purposes, such as for rehashing of a round of golf, etc.

Figure 9:
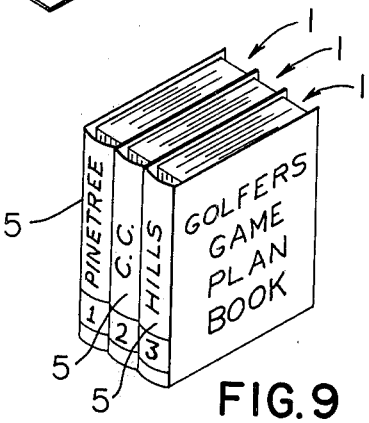

Also, the golfer can have a book means 1 for each golf course he plays whereby the back of the spine parts 5 can have appropriate label space so that a players book means 1 can be stored on his library shelves as illustrated in FIG. 9.

Thus, it can be seen that the book means or kit 1 can be merchandised in the same manner as a sport book because all of the material necessary for laying out a person's particular golf course is provided by the page means of such book means.

However, it is to be understood that only sheets 11 and 19 need be provided in each kit or book means 1 as the greens 13, tee areas 15, hazards and landmarks 16 and 17 and fairways 23, etc., can merely be drawn on the sheets 11 to practice the teachings of this invention. In fact, the smaller sheets 19 can be eliminated if desired so that the book means or kit 1 need only contain a plurality of sheets 11, if desired.

While the book means 1 has been illustrated and described as being of a note book type for easy page removal and insertion, it is to be understood that other types of page removal book means can be utilized if desired. In fact a book means of permanently attached page means could be utilized as the page means could still be copied by reproducing apparatus for the reasons previously set forth.

While there has been no discussion as to how the golfer is to provide the proper distances across the fairways, etc., it is to be understood that the golfer could use one of the smaller sheets 19 as a ruler for setting the proper widths between objects and roughs after pacing the same off. Of course a special ruler could be provided for this purpose. In any event, it can be seen that the requiring the golfer to pace the width of the fairways etc., when laying out each golf hole, the golfer will readily become aware of the more narrower and wider portions of the fairways etc., for better golf club selection and ball placement for his ability to "thread the needle" or to "play it safe".

Therefore, it can be seen that this invention not only provides a book means and page means therefor to aid a golfer in planning his round of golf for the lowest score commensurate for his ability, but also this invention provides a method for laying out a golf hole or holes for a golfer's study thereof or for other purposes as desired.

While the form of the invention now preferred has been described as required by the patent statutes, other forms may be utilized all coming within the scope of the appended claims.

What is claimed is:

1. A golfer's aid including a map of a particular golf hole that can be played actually or vicariously by a golfer comprising a sheet member having uniformally spaced apart concentrically disposed arcs defining predetermined increments of distance thereon extending away from the center of said arcs in sufficient directions that said sheet member is adapted to readily accommodate proportionally accurate layouts of the widely varying holes played by golfers, including holes having a dogleg to the right of the tee area and a dogleg to the left of the tee area with said increments of distance extending to said tee area, said sheet member having the characteristics of said particular golf hole laid out thereon and over said increments of distance thereon and comprising means disposed on said sheet member at said center to represent the golf green of said hole, means disposed on said sheet member at the appropriate distance from said center to represent the golf tee area of said hole, means disposed on said sheet member between said tee area representation and said green representation to represent the location of the landmarks and hazards of said hole that could be encountered by the golfer in playing said hole, and means adapted to be disposed on said sheet member to represent the first strategic shot path that the golfer could follow with his particular golf playing abilities or vicarious abilities to reach a first desired strategic location in attempting to reach the green of said hole in a minimum number of strokes for those abilities said means representing said first stategic shot path comprising a second sheet member adapted to be disposed on the first mentioned sheet member, said second sheet member having concentrically disposed arcs thereon spaced apart in the same increments of distance as the arcs provided on said first sheet member and extending away from the center thereof a distance sufficient to encompass said first strategic shoth path.

2. A golfer's aid as set forth in claim 1 wherein said second sheet member is substantially transparent to expose at least the majority of the first-mentioned sheet member that is covered by said second sheet member.

3. A golfer's aid as defined in claim 2 including a transparent pocket member for containing said first and second sheet members and adapted to be marked thereon to simulate ball paths and ball lies thereon in overlay on said map of a golf hole.

* * * * *